US006408577B1

(12) United States Patent
Desjoyaux et al.

(10) Patent No.: US 6,408,577 B1
(45) Date of Patent: Jun. 25, 2002

(54) STEPS FOR SWIMMING POOL

(75) Inventors: Jean Louis Desjoyaux, L'Etrat; Pierre Louis Desjoyaux, La Fouillõuse; Catherine Jandros, Orangerie, all of (FR)

(73) Assignee: Piscines Desjoyaux, S.A. (FR)

( * ) Notice: Subject to any disclaimer, the term of this patent is extended or adjusted under 35 U.S.C. 154(b) by 0 days.

(21) Appl. No.: 09/594,923

(22) Filed: Jun. 15, 2000

Related U.S. Application Data

(63) Continuation of application No. PCT/FR98/02587, filed on Dec. 2, 1998.

(30) Foreign Application Priority Data

Dec. 17, 1997 (FR) ..... 9716289

(51) Int. Cl.[7] ..... E04F 11/00

(52) U.S. Cl. ..... 52/182; 52/184; 52/188; 52/169.7

(58) Field of Search ..... 52/182, 188, 169.7, 52/184; D25/62

(56) References Cited

U.S. PATENT DOCUMENTS

| | | | | | |
|---|---|---|---|---|---|
| 3,733,621 | A | | 5/1973 | Jannuzzi, Jr. | |
| 3,755,981 | A | * | 9/1973 | West | 52/184 |
| RE29,936 | E | * | 3/1979 | Arp | 52/169.7 |
| 4,167,084 | A | * | 9/1979 | Brunton | 52/169.7 |
| 4,635,304 | A | * | 1/1987 | Zikmanis | 52/169.7 |
| 5,010,699 | A | * | 4/1991 | Maiucorro | 52/169.8 |
| D349,965 | S | * | 8/1994 | Weir | D25/2 |
| 5,644,873 | A | * | 7/1997 | Bourgault | 52/182 |
| 5,678,256 | A | * | 10/1997 | Lea | 52/182 |
| 5,752,350 | A | * | 5/1998 | Maiuccoro | 52/169.7 |

FOREIGN PATENT DOCUMENTS

| | | |
|---|---|---|
| FR | 2747417 | 10/1997 |

* cited by examiner

*Primary Examiner*—Beth A. Stephan
(74) *Attorney, Agent, or Firm*—Wall Marjama & Bilinski LLP

(57) ABSTRACT

These steps for a swimming pool are noteworthy in that they possess, projecting from the inside of the recessed front face (1*a*), at least one solid part (1*d*) that acts as a backing or support produced directly by a process of injection moulding a plastics material for the production of the body of the steps, and the said rib (1*d*) appears as an extra thickness on the inside of the face (1*a*), in the thickness of which the fixing means (2) of a liner (3) can be engaged.

4 Claims, 3 Drawing Sheets

STEPS FOR SWIMMING POOL

Figure 1:
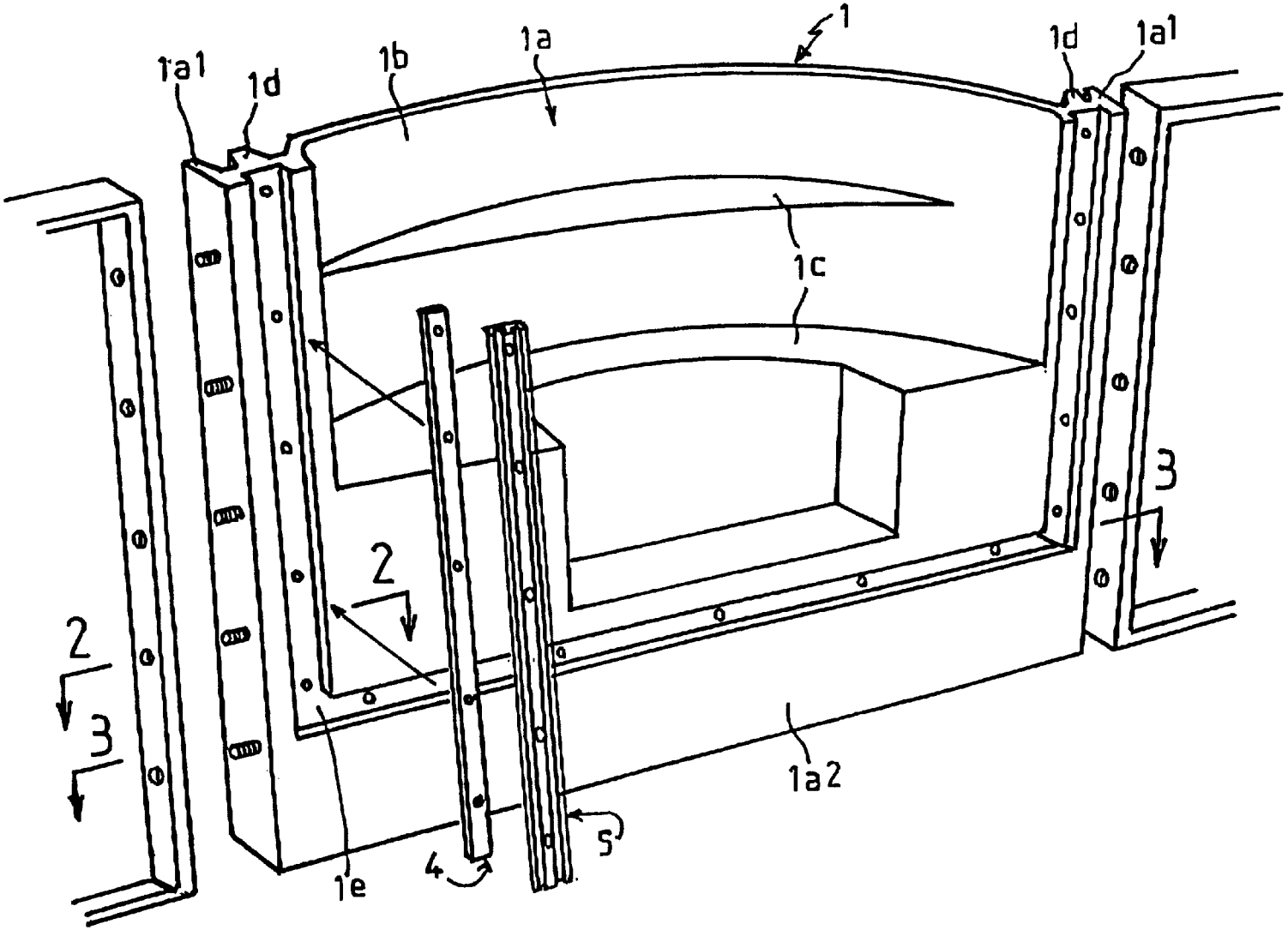

This application is a continuation of PCT/FR98/02587 filed Dec. 2, 1998.

BACKGROUND OF THE INVENTION

The invention relates to the technical field of swimming pool accessories, specifically steps for swimming pools built either from independent prefabricated panels produced in various different ways, or from any other means perfectly familiar to those skilled in the art.

More particularly, the invention relates to steps of the type defining a front face which is recessed to form the actual treads. That face of the steps which contains the recess includes connecting flanges, or other arrangements, to enable it to be fixed without discontinuity to the adjacent panels of the pool basin. The recess is very often in the general shape of a U, while the treads of the steps may have a general rounded shape so as to form steps known as Roman steps, or indeed any rectangular shape, although this does not exclude other shapes.

A number of different ways have been proposed for constructing these types of steps.

For example, the steps may be produced by means of a thermoforming manufacturing process as shown by the teaching of patent FR 2,716,406. Another proposal has been to produce this type of steps by a rotational moulding process as shown by the teaching of application WO-A-9620322.

Whatever their method of manufacture, these steps are designed, as indicated, to be connected without discontinuity to the adjacent panels or other elements of the basin of the pool and include arrangements for fixing an internal plasticized fabric or "liner". The currently proposed method of manufacture, namely essentially thermoforming and rotational moulding, necessitates the attachment of special means for fixing the liner.

The fixing of this liner is usually done in combination with a seal and a fixing clamp. These are placed in a rib formed around the perimeter of the recess of the steps. The actual fixing of the liner, in combination with the seal and the clamp, is done by means of screw or equivalent means.

It is here that major technical problems arise. In view of the method of manufacture adopted, that is thermoforming or rotational moulding, it is not possible to produce steps having sufficient thickness to allow the assembly means to be screwed in. To obtain a sufficient thickness for assembly means to be screwed in, the thickness would necessarily, owing to the constraints of the very method of manufacture itself, have to be constant at all points of the body of the steps, an option which cannot be considered in view of the consequent weight and the prohibitive cost created by having to use so large a quantity of raw material.

For this reason, considering the relatively small thickness of the steps, backings or supports have to be added in order to increase the thickness of the steps where the liner is to be fixed in position, in order for the fixing means to be able to be screwed in. These backings, which may be made of wood, plastic or other material, are generally bonded or screwed to the outside face of the steps along the line of the groove in which the seal and assembly clamp of the liner will be placed Reference is made to FIG. 4 of application WO-A-9620322.

consequently, if the recess is of a general U shape, the attached fixing backings must follow the same shape, which means that a plurality of independent elements must be used. This necessity of adding a fixing support to enable the assembly means to be screwed in creates many problems.

In the first place it is clear that fixing the backings is a long and difficult operation which must of course be carried out in a workshop. The different elements must first be cut to the desired length and correctly fitted together at the corners. Fitting the support elements together at the corners can be done in a conventional way, either by mitre joints, or by simply laying the constituent elements side by side at 90°. Whichever method is adopted, there is a gap at the corner resulting from the side-by-side position of the fixing supports. It is therefore important that the screw holes be located very precisely in order to ensure that the assembly means do not emerge at these gaps. It is not in practice possible to guarantee completely that at least one of the liner fixing screws does not coincide with this gap, which means that, under the action of screwing, the support elements are pushed apart, which may consequently lead to problems in assembling the liner as a whole.

Clearly, besides the fact that the technical result obtained is not always satisfactory for the reasons indicated, there are large costs involved in the requisite preparatory work.

SUMMARY OF THE INVENTION

The object of the invention is to remedy these problems in a simple, reliable, effective and efficient manner.

The problem addressed by the invention is how to avoid the need to add backings or other elements for the fixing of the liner, as for example by means of screws or the like, without thereby increasing the thickness of the steps but rather with the aim of actually reducing such a thickness.

To solve such a problem, steps for a swimming pool have been devised and developed of the type defining, in a known manner, a front face which is recessed to form the treads, the said face being shaped to allow connection with adjacent panels or other elements of the basin of the pool.

According to the invention, the steps possess, projecting from the inside of the recessed front face, at least one solid part forming a rib that acts as a backing or support produced directly by a process of injection moulding a plastics material for the production of the body of the steps, in the thickness of which backing the fixing means of a liner can be engaged.

Given these technical arrangements, the fixing means can be screwed directly into the thickness of the solid part of the steps, whose thickness is determined to avoid the use of any add-on element or support.

In view of the problem addressed by the invention of fixing the liner around the recess in which the steps are formed, the rib is facially of a geometrical U shape corresponding to that of the recess.

In view of the problem addressed by the invention of manufacturing the steps by an injection moulding process, the lateral edges of the rib are inclined in a converging manner to permit demoulding.

In order to solve the problem of fixing the liner in a watertight manner along the line of the rib, the recessed front face includes a groove for a seal for the watertight fixing of the liner in combination with a clamping strip using fixing means engaged in the thickness of the said rib.

In view of the production of the steps by an injection moulding process, it is possible to obtain directly, upon their manufacture, internal reinforcing ribs making it possible to significantly reduce the thickness of the body of the steps.

With this process, steps whose thickness is generally 8 mm can be reduced to 5 mm for example.

BRIEF DESCRIPTION OF THE INVENTION

Figure 2:
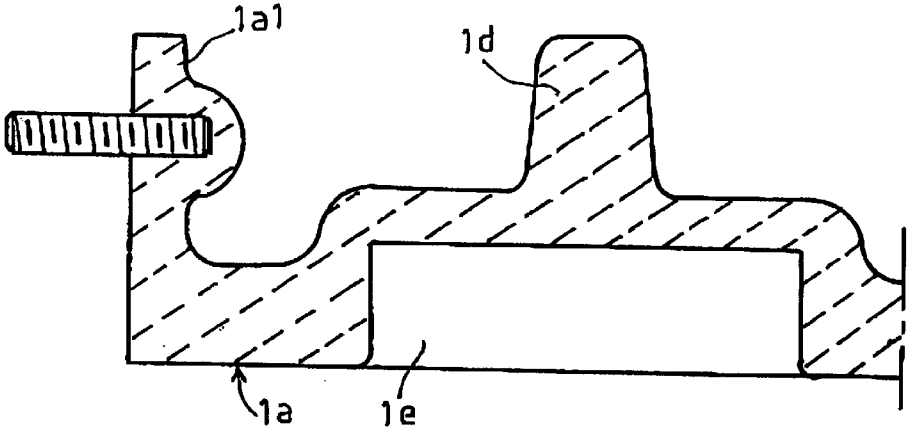
Figure 4:
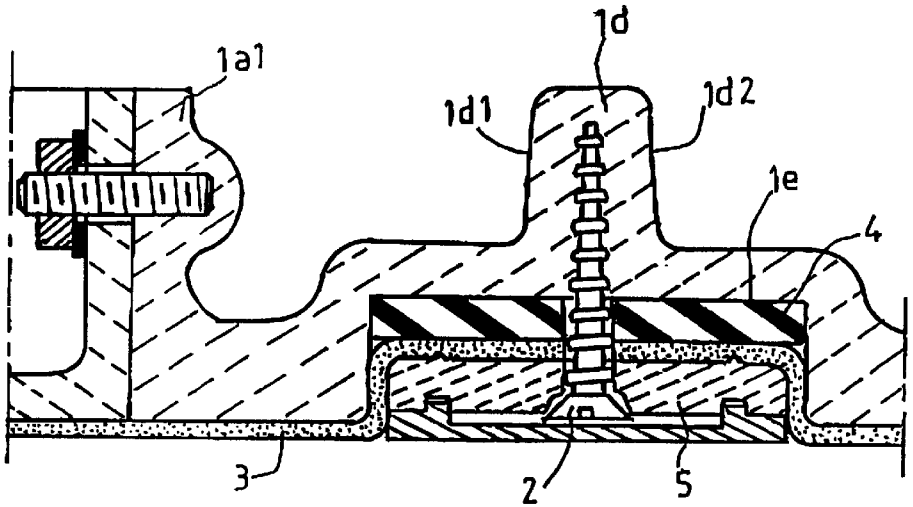
Figure 3:
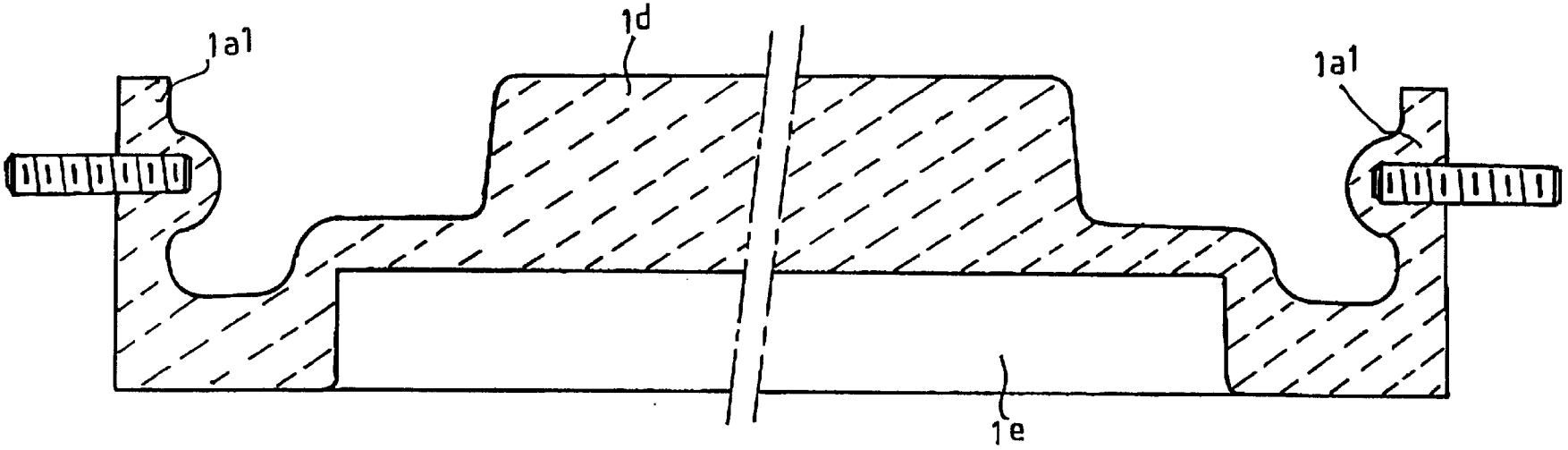

The invention is set out below in greater detail with the aid of the figures of the appended drawings, in which:

FIG. 1 is a perspective view of an embodiment of the steps according to the features of the invention, FIG. 2 is a cross section taken on 2.2 as shown in FIG. 1, FIG. 3 is a cross section taken on 3.3 as shown in FIG. 1, and FIG. 4 is a cross section showing how the liner is fixed in place.

DESCRIPTION OF THE INVENTION

As is perfectly familiar to those skilled in the art, the steps may come in different geometrical shapes. The steps denoted in their entirety by (1) have a front face (1*a*) defining a recess (1*b*) in which the treads (1*c*) of the steps are formed. The recessed front face (1*a*) is shaped to allow connection without discontinuity, in an adjacent manner, with the panels of the basin of the pool.

In the example illustrated, the recess (1*b*) has a general U shape, the general shape of the face (1*a*) being quadrilateral and has [sic] two vertical arms (1*a*1) joined by a horizontal lower arm (1*a*2) which thus form the edges of the recess (1*b*).

According to a fundamental feature of the invention, the recessed front face of the steps possesses, projecting from its inside, a solid part (1*d*), in the thickness of which the fixing means (2) of a liner (3) can be engaged.

The solid part (1*d*) forms a rib which appears as an extra thickness on the inside of the face (1*a*) and whose thickness is determined so that the fixing means (2) can be screwed in. This rib (1*d*) is of a geometrical shape corresponding to that of the recess (1*b*). In the example illustrated, the rib (1*d*) is therefore of a general U shape. This rib (1*d*) is produced directly during the manufacture of the steps, which are produced by a process of injection moulding of a plastics material.

The lateral edges (1*d*1) and (1*d*2) of the rib are inclined in a converging manner to permit demoulding.

In view of the application of the method of injection moulding to the production of steps for swimming pools, it is possible to incorporate directly, at the time of manufacture, a relief area that will permit the engagement of fixing means. This area may also be formed by a plurality of studs set out at intervals around the perimeter which is defined by the geometrical shape of the recess.

In view of the actual fixing of the liner along the line of the rib (1*d*), the recessed front face of the steps includes a groove (1*e*) for a seal (4) for the watertight fixing of the liner (3) in combination with a strip (5) using fixing means (2) screwed into the thickness of the rib (1*d*) (FIG. 4). It is to be observed that the different arrangements for the fixing of the liner, in combination with the rib (1*d*), are given by way of indication and do not imply any limitation. Other equivalent means can be used for the purpose of fixing the liner in a watertight manner using means screwed into the rib (1*d*).

Since the steps (1) as a whole are produced by injection-moulding a plastics material, it is possible also to provide, when manufacturing the latter, internal reinforcing ribs. These arrangements enable the thickness of the steps as a whole to be reduced in consequence.

The advantages are very clear from the description. In particular it should be underlined and stressed that the application of the injection moulding process to the production of steps for swimming pools makes it possible to produce directly, at the time of manufacture of the steps, one or more ribs that also act as fixing supports for the liner, and optionally one or more reinforcing ribs that will allow the thickness of the steps as a whole to be reduced as a consequence.

What is claimed is:

1. Steps for a swimming pool that define a recessed front face shaped to form treads, said steps further arranged for connection without discontinuity to other adjacent panels or other elements of a basin of said swimming pool, said steps further having a plurality of ribs on each front end of said recessed front face, said ribs providing additional thickness on the inside of said recessed front face with spacings between adjacent said ribs designed to act as grooves for supporting an internal plasticized fabric or liner, said grooves being capable of accepting a clamping strip for engaging said internal plasticized fabric or liner to said grooves for a seal for watertight fixing of said internal plasticized fabric or liner to said grooves using fixing means in said extra thickness of said ribs, said steps with the ribs being made by a process of injection molding a plastic material.

2. Steps according to claim 1, wherein said grooves are U-shape.

3. Steps according to claim 1, wherein said grooves are semicircular.

4. Steps according to claim 1, wherein said steps are Roman steps.

* * * * *